United States Patent [19]

Hale et al.

[11] Patent Number: 4,746,270

[45] Date of Patent: May 24, 1988

[54] ENGINE WATER PUMP ASSEMBLY AND METHOD OF MAKING SAME

[75] Inventors: Keith F. Hale, Rochester Hills; Joseph Paliwoda, W. Bloomfield; Verle Propst, Rochester, all of Mich.

[73] Assignee: Deco-Grand, Inc., Troy, Mich.

[21] Appl. No.: 75,407

[22] Filed: Jul. 20, 1987

[51] Int. Cl.[4] ..... F04D 29/04

[52] U.S. Cl. ..... 415/170 A; 384/296; 29/156.4 R

[58] Field of Search ..... 415/170 R, 170 A; 384/296, 152, 441; 29/156.4 R, 453, 525

[56] References Cited

U.S. PATENT DOCUMENTS

| | | | |
|---|---|---|---|
| 3,218,906 | 11/1965 | Dupree | 29/453 |
| 4,080,112 | 3/1978 | Zimmermann | 415/215 |
| 4,172,310 | 10/1979 | Mincuzzi | 415/170 A |
| 4,201,521 | 5/1980 | Carlson | 29/156.4 R |
| 4,488,825 | 12/1984 | Cavagnero et al. | 284/152 |
| 4,532,690 | 8/1985 | Del Bon et al. | 29/453 |
| 4,650,398 | 3/1987 | Brandenstein et al. | 415/170 A |

FOREIGN PATENT DOCUMENTS

| | | | |
|---|---|---|---|
| 2752058 | 5/1979 | Fed. Rep. of Germany | 384/296 |
| 876108 | 10/1942 | France | 29/156.4 R |
| 1217108 | 12/1970 | United Kingdom | 384/441 |

*Primary Examiner*—Robert E. Garrett
*Assistant Examiner*—John T. Kwon
*Attorney, Agent, or Firm*—Cullen, Sloman, Cantor, Grauer, Scott and Rutherford

[57] ABSTRACT

An engine water pump assembly is formed of a rotatable shaft divided along its length into a bearing portion terminating in a drive connection and a sealing portion terminating in an impeller end upon which a water impeller is mounted. A tubular, journal-type bearing surrounds the shaft bearing portion. A pump housing surrounds the shaft and bearing and has an integral, enlarged chamber formed on one end within which the impeller is located. The opposite end of the housing has an opening through which the shaft drive connection extends. The bearing has an integral, annular flange which surrounds a part of the shaft sealing portion. A seal mounted upon the shaft sealing portion seals against the flange to prevent the flow of water from the impeller chamber to the bearing part of the housing and its opening. The housing is molded around the bearing to form an integral subassembly. The shaft and seal may be pre-assembled and then inserted, as a subassembly, through the housing chamber towards and into the bearing and its flange.

7 Claims, 2 Drawing Sheets

ENGINE WATER PUMP ASSEMBLY AND METHOD OF MAKING SAME

BACKGROUND OF INVENTION

This invention relates to an improved construction of, and a method of constructing, the main assembly of an automotive engine type of water pump. Such pumps are used for circulating the coolant fluid, that is, the water and anti-freeze mixture, used in automotive-type engines.

An engine water pump essentially consists of a rotating shaft, which has an impeller mounted on one end and a drive gear or connection on the other end, all arranged within a sealed housing. The housing includes an enlarged impeller chamber within which the pump impeller is positioned. The shaft passes through a bearing contained within the housing. A seal arranged around the shaft between the impeller and the bearing prevents the leakage of coolant between the impeller chamber and the bearing. Coolant is directed into the impeller chamber where it is pumped, by the impeller, out through an outlet so that it moves through the automotive engine passageways for cooling the engine. The drive gear end of the pump shaft is driven by a suitable power take-off from the engine, such as through a gear system, or belt system or the like.

Typically, the housing for the main assembly of the pump is made of a casting, as for example, an aluminum die casting. The housing is formed of a roughly cylindrical body portion which widens at one end into the impeller chamber. The body portion is ordinarily constricted at about its middle to form two sections. A pump seal is inserted in one section and a ball-type bearing, with an exterior race, is arranged in the other section. Inner races for the balls may be formed by providing grooves in the pump shaft so that the balls are confined between the grooves in the shaft and the external race. Additionally, suitable sealing rings are installed or formed in situ around the bearing race for sealing it against the interior of the housing.

Generally, the conventional main assembly is assembled within the housing by applying the bearing parts upon one end of the shaft, inserting the shaft and bearing into one end of the housing, and then applying the seal and the impeller, upon the opposite portions of the shaft and into the opposite end of the housing. That is, for assembly, the parts are installed through both ends of the housing. That assembly is relatively time-consuming to accomplish and consequently, expensive. In addition, the housing, the bearing and the systems used for sealing the bearing to the housing are relatively expensive parts which require considerable labor to produce. A considerable amount of machining is required to finish a number of the surfaces in order to obtain the accuracy necessary in the finished pump.

Thus, the invention herein is concerned with an improvement in the bearing construction by which the pump parts may be assembled from one direction into the housing, rather than from both directions, and wherein the bearing and the bearing seal arrangement are considerably simplified to eliminate a considerable portion of the previously required machining and assembly operations. In addition, the invention is concerned with forming a main pump assembly which is of lesser weight than that previously used.

SUMMARY OF INVENTION

The invention herein contemplates forming a pump main assembly with a tubular, journal-type bearing permanently molded within a plastic molded pump housing to form a complete subassembly. The shaft of the pump, with the shaft seal mounted thereon, may be inserted in the housing through the housing-enlarged impeller chamber and into position within the bearing. The impeller, itself, may be pre-assembled on the pump shaft so that it may form part of the shaft, shaft seal, impeller subassembly which permits the unit to be rapidly put together with minimal labor and time. Moreover, the invention contemplates forming the plastic molded housing in a manner which eliminates machining operations on the housing while nevertheless preserving the accuracy of the mounting openings and bearing location in the housing.

An object of this invention is to provide a pump construction, and a method for assembling the pump construction, which permits forming the major components of the pump in subassemblies and then inserting one subassembly within another from a single direction. This eliminates a considerable part of the labor and manufacturing steps previously required in the present pumps.

A further object of this invention is to form a pump main assembly with a plastic housing, within which a bushing or journal-type bearing is integrally molded, and with mounting screw openings formed in metal inserts which are precision-located within the molding during the molding process so as to eliminate housing machining operations that were previously required for pumps.

Still another object of this invention is to form a pump wherein the shaft is mounted within a molded in place bushing or journal-type bearing so as to eliminate the prior machining operations required in the use of ball or roller bearings in automotive engine pumps and so as to facilitate the assembly of the pump shaft within the bearing.

In general, an overall objective of this invention is to substantially reduce the cost of manufacturing, assembling and handling the main component of the coolant pump used with an automotive-type engine, while simultaneously decreasing the weight, but maintaining the dimensional accuracy, of the pump.

These and other objects and advantages of this invention will become apparent upon reading the following description, of which the attached drawings form a part.

DETAILED DESCRIPTION

Figure 1:
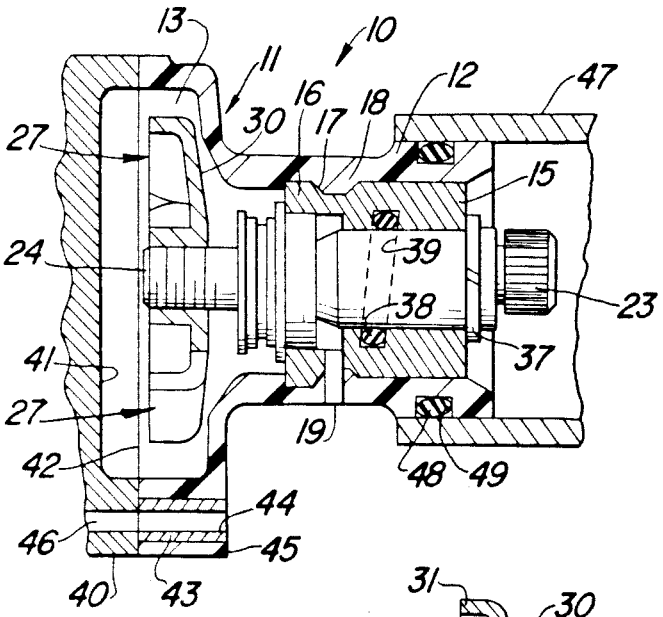
FIG. 1 is a cross-sectional view of the water pump main assembly with a fragmentary view of its cover and support.
Figure 3:
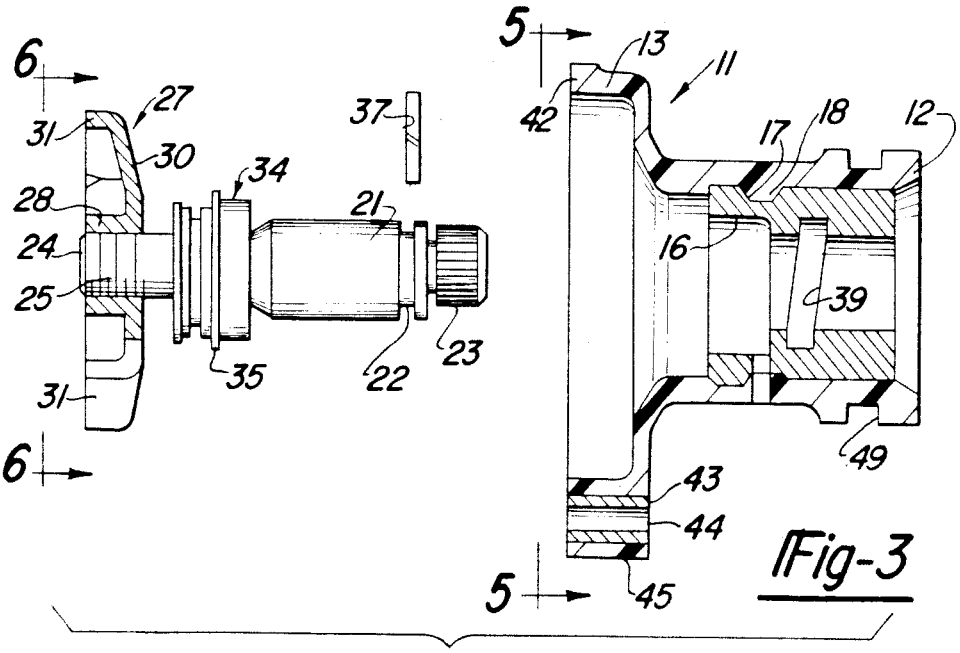
FIG. 3 illustrates the shaft-seal-impeller subassembly aligned for insertion within the housing-bearing subassembly.

The water pump 10, as illustrated in FIGS. 1 and 3, includes a main assembly housing 11 which is molded out of plastic. The housing includes a cylindrdical body portion or chamber portion 12 and an integral, enlarged impeller chamber portion 13.

Molded within the housing is a tubular bushing or journal bearing 15. The bearing may be made of a suitable bearing material, such as an appropriate bronze metal or the like. The bushing includes an annular flange 16 having a continuous, annular groove 17 formed in its outer surface. During the molding of the housing around the bearing, a rib-like formation 18 molded integrally within the housing, fits into and interlocks within the groove 17. One or more drain holes 19 may be formed within the rib-like formation and bushing for the drainage of any liquid that may be trapped in that part of the housing.

Figure 2:
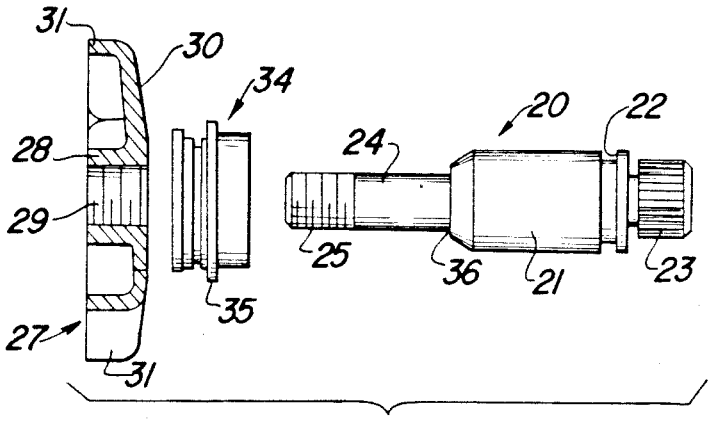
FIG. 2 is an elevational view showing the disassembled shaft, seal and impeller in alignment for assembly.

The pump shaft, as illustrated in FIG. 2, is formed with a journal or bearing portion 21. The free end of that portion is formed with a groove 22 for receiving a retainer ring. The shaft terminates in gear-like connector 23, which may be machined into the shape of a spur gear or the like for driving the shaft.

Figure 6:
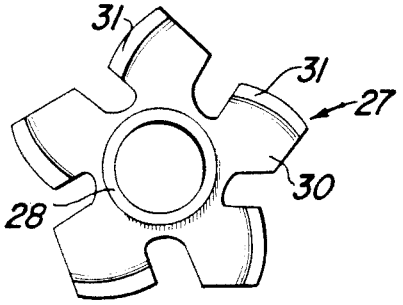
FIG. 6 is a face or end view of the impeller taken in the direction of arrows 6—6 of FIG. 3.

A narrowed or small diameter portion 24 is formed on the shaft and terminates in a threaded end 25 upon which the impeller 27 may be mounted. The impeller (see FIGS. 2 and 6) may be formed of a sheet metal stamping having a central hub 28 with an internal thread 29 for interlocking with the threaded end of the shaft. The impeller has an integral disc or base portion 30 which is cut and bent into blades 31. Rotation of the impeller causes the circulation of liquid, such as the water coolant used in an automotive engine. The impeller itself is conventional and forms no part of the invention of this application.

A shaft seal 34 is force-fitted on the smaller diameter part of the shaft. The seal includes an annular lip 35 which abuts against the end of the annular flange 16 on the bearing 15. In addition, it may bottom against a shoulder 36 formed on the shaft at the junction between the smaller diameter portion and the larger diameter bearing portion.

The shaft 20, with the force-fitted seal 34 and the impeller 27, may form a single subassembly. The impeller may be both threaded upon the shaft and also may be heat-sealed or welded to it. That subassembly is inserted into the housing-bearing subassembly by pushing it through the housing impeller chamber portion 13 towards the opposite, open end of the housing. When the shaft-enlarged bearing portion is properly aligned within the bearing 15, a split retainer ring or retainer washer 37 is forced into the groove 22 on the shaft to prevent withdrawal of the shaft from the housing.

The shaft is journaled within the bearing for rotation. In addition, an O-ring 38 is arranged within an inner groove 39 formed within the bearing to seal against the passage of water or oil. The O-ring may be of a conventional circular shape. However, preferably it is formed of a quad-ring configuration, that is, a cross-sectional shape which is similar to a four-leaf clover, without the stem. This is a commercially available type of sealing ring which is effective for this purpose.

The main assembly is provided with a conventional pump cover 40 containing passageways 41 for the movement of fluid to and from the impeller. The details of the cover and passageways are omitted as these are conventional. The cover is placed against a face or flange edge 42 formed on the impeller chamber. Tubular metal inserts 43 are molded within the housing, that is, within molded ears 45 which are integral with the housing. These inserts have central bolts or screw holes 44 which align with holes 46 formed in the cover.

The opposite, cylindrical end of the housing is fitted within a sleeve 47 to which it is sealed by an O-ring 48 arranged within a groove 49 in the housing. A suitable drive connection which meshes with the gear 23 and is located within the sleeve 47 causes rotation of the shaft. The drive mechanism which may be driven by a pulley, connected to an engine pulley, is omitted as it is conventional.

Figure 7:
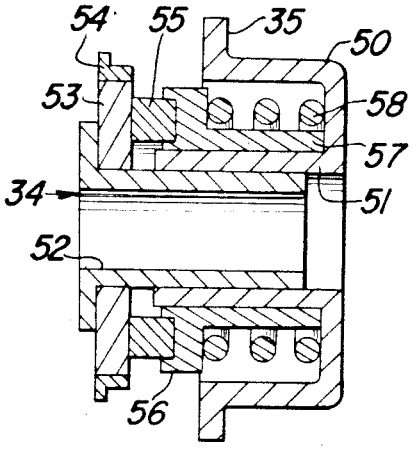
FIG. 7 is a cross-sectional view of the seal.

The shaft seal 34 may be a conventional type for sealing against leakage around the shaft 24. For example, as is schematically shown in FIG. 7, the seal may comprise an outer cup 50, upon which the annular lip 35 is formed, having an integral bearing tube portion 51. A shaft tube 52, which is force-fitted upon shaft 24, rotates with shaft 24 within the tube portion 52. A plastic seal disk 53, enclosed within an edge ring 54, rotates with the shaft tube 52. The disk seals against a metal sealing ring 55.

Ring 54 is embedded within a flange 56 formed on sleeve 57. This flange, with its ring 54, is forced towards the seal disk by a spring 58 that encircles the sleeve and is compressed between the interior of the cup 50 and the flange 55.

Figure 4:
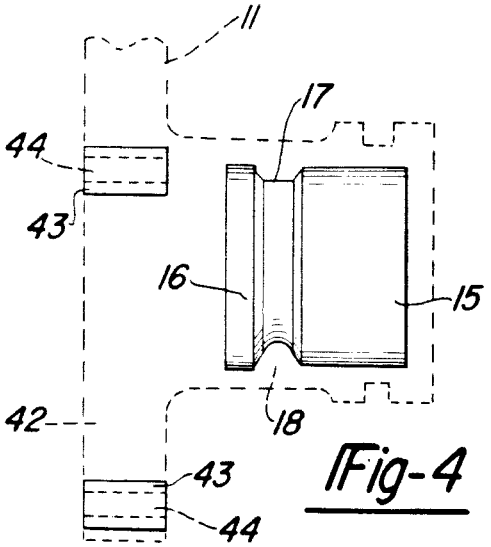
FIG. 4 is a schematic view illustrating the bearing and screw inserts aligned for molding within the housing.
Figure 5:
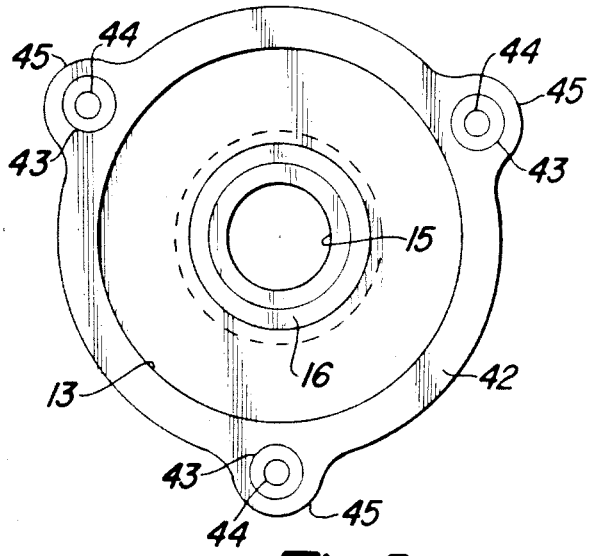
FIG. 5 is a view, taken in the direction of arrows 5—5, of the impeller end of the housing.

As illustrated in FIG. 4, the housing is molded within a suitable injection molding cavity. Before the molding, the bearing 15 is placed within the cavity. In addition, the metal inserts 43 are located within the cavity. Thus, there is a precise relationship established between the center line of the bearing and the center lines of the holes through the inserts. That establishes the dimensional accuracy of the housing and of the pump. After the alignment of the bearing and inserts within the mold, the mold is closed and the housing is injection molded out of a plastic suitable for the purpose. The selection of the plastic is within the purview of one skilled in the art, depending upon the availability, cost and structural and physical requirements for the product. There are a number of commercially available plastics useful for this purpose.

Figure 8:
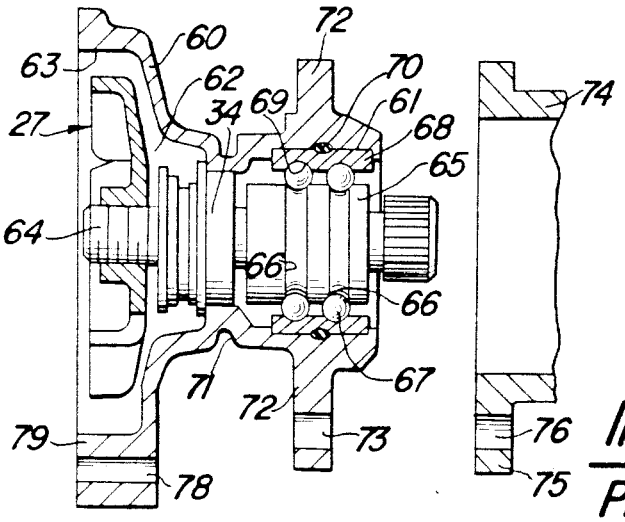
Fig-8 PRIOR ART
FIG. 8 is a cross-sectional view of a prior art water pump.

The water pump of this invention is much less expensive to produce and is lighter in weight than the prior art water pumps presently used. This contrast appears in comparing a conventional water pump, which is illustrated in FIG. 8, with the novel water pump illustrated in FIG. 1.

The conventional, prior art water pump is made with a die cast aluminum metal housing 60 provided with three chambers, namely, a bearing chamber or section 61, a seal chamber 62, and an enlarged impeller chamber 63.

The pump shaft 64 has a bearing portion 65 of an enlarged diameter within which are machined grooves 66 that provide ball bearing races. Ball bearing balls 67 are arranged in the races and are retained there by an outer, tubular race 68. The inner surface of the outer race has grooves 69 that receive the balls. A sealing O-ring 70 seals the outer race to the inner surface of the housing bearing chamber or section 61.

An integral throat or narrowed portion 71 separates the housing bearing section 61 from the seal chamber 62. The seal 34, which is similar to the one described above, is force-fitted over the shaft and also is force-fitted and sealed against the edge defining the throat 71. Thus, the major portion of the seal extends within the seal chamber of the housing.

As described above, the impeller 27 is mounted upon the impeller end 64 of the shaft.

An annular flange 72 is formed on the housing and is provided with bolt holes 73. The sleeve 74, containing the conventional drive mechanism, has an edge flange 75 with holes 76 that align with the holes 73 in the housing flange. Suitable bolts or screws are inserted through the aligned holes to fasten the housing and the sleeve together.

In addition, holes 78 are formed in the impeller chamber edge flange. Suitable bolts or screws extended through the holes 78 connect with aligned holes formed in the pump cover (not shown).

Significantly, with the prior art construction, the assembly must be made from both ends of the housing. That is, the seal 34 must be placed upon the shaft and moved from left to right (with respect to the assembly shown in FIG. 8) until it fits within the throat. The ball bearing parts must be moved into the housing from the opposite end, i.e. from right to left.

In addition, the various contacting parts of the assembly must be machined to produce an accurate assembly. For example, the holes 78 and the facings around the holes must be machined. The same type of machining is required for the holes 73 in the flange 72. Considerable machining is required to accurately form the races in the shaft and to manufacture the outer race and the housing surface against which it fits. The assembly of the bearing required considerable labor and care.

As can be seen, the main pump assembly of this invention provides an accurately dimensioned housing-bearing-mounting hole (i.e. within the inserts) subassembly into which the other subassembly of the shaft-seal-impeller may be easily inserted from one direction. The machining of mating parts and to obtain the dimensional accuracy required in the prior art pump is eliminated. Consequently, the pump of this invention is much less expensive to manufacture and assemble. Moreover, this pump has the benefit of being lighter weight since the plastic used in the housing is lighter in weight than the metal housing.

Having fully described an operative embodiment of this invention, I now claim:

1. In an automotive engine water pump assembly having a rotatable shaft with a drive end provided with connection means for rotating the shaft and an opposite impeller end upon which a water impeller is mounted, and with the shaft being divided along its length into a bearing portion adjacent the drive end and a sealing portion adjacent the impeller end; and having a bearing surrounding the shaft bearing portion; with a housing having a body surrounding the shaft and bearing along their lengths and having an enlarged chamber around the impeller end of the shaft, within which the impeller is positioned; and a seal surrounding the shaft seal portion for sealing against the flow of water from the housing impeller chamber to the housing bearing surrounding part, the improvement comprising:

said bearing being formed of a unitary, tubular bushing whose interior surface is adjacent the overlapped bearing portion of the shaft;

and said bearing having an integral, annular flange formed on one end for surrounding the part of the shaft sealing portion which is adjacent the shaft bearing portion;

the housing being formed of an integral plastic molding, with the bearing being bonded to the surrounding surface of the interior of the wall of the housing body;

and said seal extending within and sealing the shaft against said bearing flange;

whereby the housing and bearing may be formed in a single subassembly, and the shaft and seal may be formed as a separate subassembly, and the shaft and seal subassemblies may be inserted in an axial direction into the housing through the impeller chamber to position the shaft bearing portion within the bearing for assembly of the pump.

2. In a pump assembly as defined in claim 1, and including said bearing having an annular groove formed in its outer surface, and a portion of the housing molding extending into the groove for interlocking with the bearing.

3. In a water pump as defined in claim 1, and including an annular groove formed in the interior surface of the bearing, and a sealing ring arranged in said groove for sealing the bearing against the adjacent surface of the shaft.

4. In a water pump as defined in claim 1, and said housing being integrally molded around the bearing for bonding the bearing to the interior of the wall of the housing body.

5. A method for making an engine water pump assembly having a rotatable shaft with a drive end and an impeller end upon which a water impeller is mounted, with the shaft being divided between its ends into a bearing portion adjacent the drive end and a sealing portion adjacent the impeller end, with a bearing surrounding the shaft bearing portion, and a housing formed with a body surrounding the shaft and the bearing and with an enlarged chamber at the impeller end of the shaft within which the impeller is positioned, and a seal surrounding the shaft seal portion and arranged to seal water flow from the housing impeller chamber to the part of the housing surrounding the bearing, comprising:

forming a bearing in the shape of a tubular bushing having an interior wall sized for closely surrounding the shaft bearing portion, and having an exterior wall and an annular flange extending longitudinally of the exterior wall;

molding the housing out of plastic within a molding cavity within which the bearing has been prepositioned with its flange extending towards the impeller chamber for simultaneously molding the housing and bonding it to the exterior wall of the bearing and the annular flange to form a housing-bearing subassembly;

inserting the preformed shaft in a longitudinal direction into the bearing through the housing-enlarged chamber, and arranging the seal to fit around the shaft at least partially within the annular flange, and arranging the impeller within the impeller chamber.

6. A method as defined in claim 5, and including mounting the seal upon the shaft sealing portion to form a subassembly;

inserting the subassembly longitudinally into the bearing and housing, starting with the shaft drive end, until the shaft bearing portion is arranged within the bearing and the seal is arranged within the flange.

7. A method as defined in claim 6, and including mounting the impeller upon the shaft-seal subassembly before inserting the shaft into the housing, for thereby positioning the impeller within the housing impeller chamber at the same time as the shaft bearing portion is positioned within the bearing.

* * * * *